US005782050A

United States Patent [19]

Boeshart

[11] Patent Number: 5,782,050

[45] Date of Patent: Jul. 21, 1998

[54] TWO-PIECE CORNER TIE

[76] Inventor: Patrick E. Boeshart, P.O. Box 774, Sioux City, Iowa 51102

[21] Appl. No.: 813,857

[22] Filed: Mar. 7, 1997

[51] Int. Cl.[6] ..... E04G 17/02

[52] U.S. Cl. ..... 52/426; 52/250; 52/285.1; 52/699; 249/40; 249/44; 249/213

[58] Field of Search ..... 52/426, 428, 699, 52/309.12, 309.11, 285.1, 250; 249/40, 44, 45, 191, 194, 213, 216

[56] References Cited

U.S. PATENT DOCUMENTS

| | | | |
|---|---|---|---|
| 836,245 | 11/1906 | Crawford . | |
| 963,776 | 7/1910 | Kosack . | |
| 1,053,231 | 2/1913 | Schweikert | 52/426 |
| 2,029,082 | 1/1936 | Odam . | |
| 2,763,048 | 9/1956 | Sullivan . | |
| 2,776,464 | 1/1957 | Stewart . | |
| 3,362,739 | 1/1968 | Staeger et al. . | |
| 3,662,985 | 5/1972 | Parker . | |
| 3,989,397 | 11/1976 | Baker . | |
| 4,154,362 | 5/1979 | McKenney . | |
| 4,320,888 | 3/1982 | Oury . | |
| 4,563,381 | 1/1986 | Woodland . | |
| 4,604,843 | 8/1986 | Ott et al. . | |
| 4,698,946 | 10/1987 | Wendt . | |
| 4,784,509 | 11/1988 | Gozzano . | |
| 4,860,515 | 8/1989 | Browning, Jr. . | |
| 4,888,931 | 12/1989 | Meilleur . | |
| 4,889,310 | 12/1989 | Boeshart . | |
| 4,916,879 | 4/1990 | Boeshart . | |
| 5,039,058 | 8/1991 | Boeshart . | |
| 5,520,477 | 5/1996 | Fink . | |
| 5,608,999 | 3/1997 | McNamara | 52/426 X |
| 5,658,483 | 8/1997 | Boeshart | 249/216 X |

FOREIGN PATENT DOCUMENTS

| | | |
|---|---|---|
| 2439807 | 3/1976 | Germany . |
| 400820 | 4/1966 | Switzerland . |
| 2064617 | 6/1981 | United Kingdom . |

*Primary Examiner*—Robert Canfield
*Attorney, Agent, or Firm*—Zarley, McKee, Thomte Voorhees & Sease; Mark D. Frederiksen

[57] ABSTRACT

A two-piece corner tie includes first and second tie halves which are removably connected together. The first tie half includes forward and rearward form panel retainers for holding form panels in upright spaced apart parallel relationship. The second tie half is preferably identical to the first tie half, and retains a second pair of form panels in upright spaced apart parallel relationship. The tie halves are connected by a pair of pins journaled through co-axial sleeves, to retain a first pair of form panels at a predetermined angle relative to a second pair of form panels, to thereby form a corner.

7 Claims, 2 Drawing Sheets

TWO-PIECE CORNER TIE

TECHNICAL FIELD

The present invention relates generally to ties for concrete wall systems, and more particularly to a special tie utilized to secure the ends of form panels at a corner joint, so as to form a corner in a completed poured concrete wall.

BACKGROUND OF THE INVENTION

While wall forming systems have been in use for many years, a relatively recent development in this industry is in the use of expanded polystyrene panels as forms for poured concrete walls. After the concrete has hardened, the panels may be left in place on the walls to serve as permanent insulation, or they may be stripped off to reveal the exposed concrete.

Upon introduction of this new wall forming system, it was found that it was unnecessary to use small "building blocks" to create the form panels to build a form system for receiving poured concrete. Rather, larger and longer panels are now being utilized to create the concrete forms of the forming system. As the panels grew in size, the applicant herein devices new types of ties for various applications of the forming panels in concrete forming systems. While the various ties invented by the applicant herein have proved successful for their various purposes, it was always necessary to utilize a special additional framing system to hold the form panels at a corner where two walls meet.

Right angle corners and "T" intersections were provided with a special corner tie devised by the applicant herein, and described in U.S. Pat. No. 4,916,879. While the tie of '879 patent serves well for its intended purpose, the applicant has found a simpler, more economic, and more flexible method for connecting the ends of a pair of form panels at a corner joint, whether the joint be at a right angle, or some other angle.

SUMMARY OF THE INVENTION

It is therefore a general object of the present invention to provide a special corner joint tie for use with polystyrene panel-type forms on poured concrete walls.

Another object is to provide a concrete wall form tie which will rigidly hold the form panels necessary to pour a corner in a poured concrete wall.

Still a further object of the present invention is to provide a two-piece tie which may be attached to the ends of two pairs of form panels and which may be interconnected in order to form a corner in a poured concrete wall.

These and other objects of the present invention will be apparent to those skilled in the art.

The two-piece corner tie of the present invention includes first and second tie halves which are removably connected together. The first tie half includes forward and rearward form panel retainers for holding form panels in upright spaced apart parallel relationship. The second tie half is preferably identical to the first tie half, and retains a second pair of form panels in upright spaced apart parallel relationship. The tie halves are connected by a pair of pins journaled through coaxial sleeves, to retain a first pair of form panels at a predetermined angle relative to a second pair of form panels, to thereby form a corner.

DESCRIPTION OF THE PREFERRED EMBODIMENT

Figure 1:
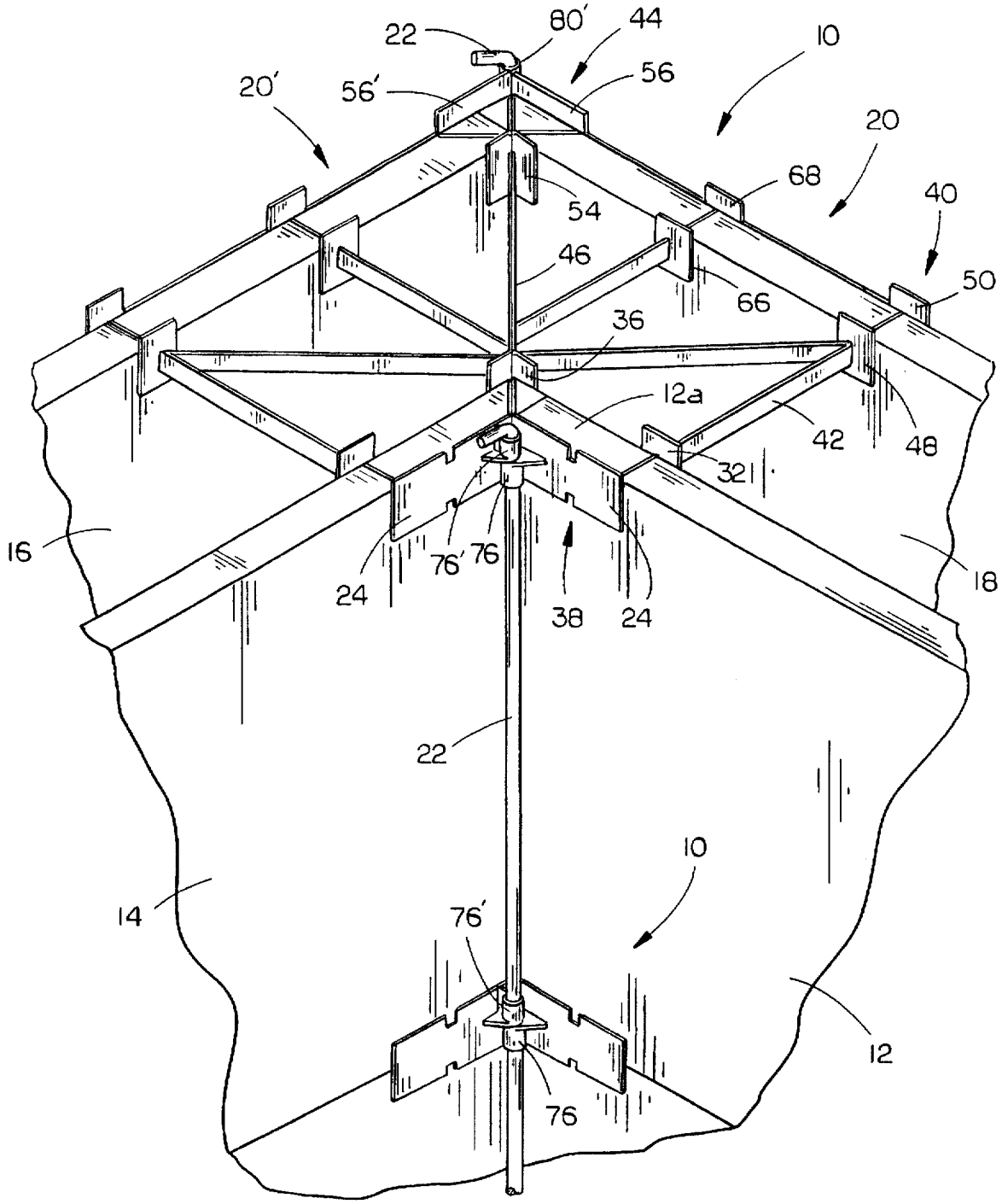
FIG. 1 is a perspective view of the two-piece corner joint tie of the present invention installed on a right angle corner formed from concrete form panels.

Referring now to the drawings, in which similar or corresponding parts are identified with the same reference numeral throughout the drawings, and more particularly to FIG. 1, the corner joint tie of the present invention is designated generally at 10 and is shown securing the ends of a plurality of form panels 12, 14, 16, and 18, arranged as a forming system to create a right angle corner in a poured concrete wall. As shown in FIG. 1, form panels 12 and 18 are parallel to one another, to form a first wall, and panels 14 and 16 are parallel to one another to form a second wall intersecting the first wall at a predetermined angle between 0° and 180°.

Figure 2:
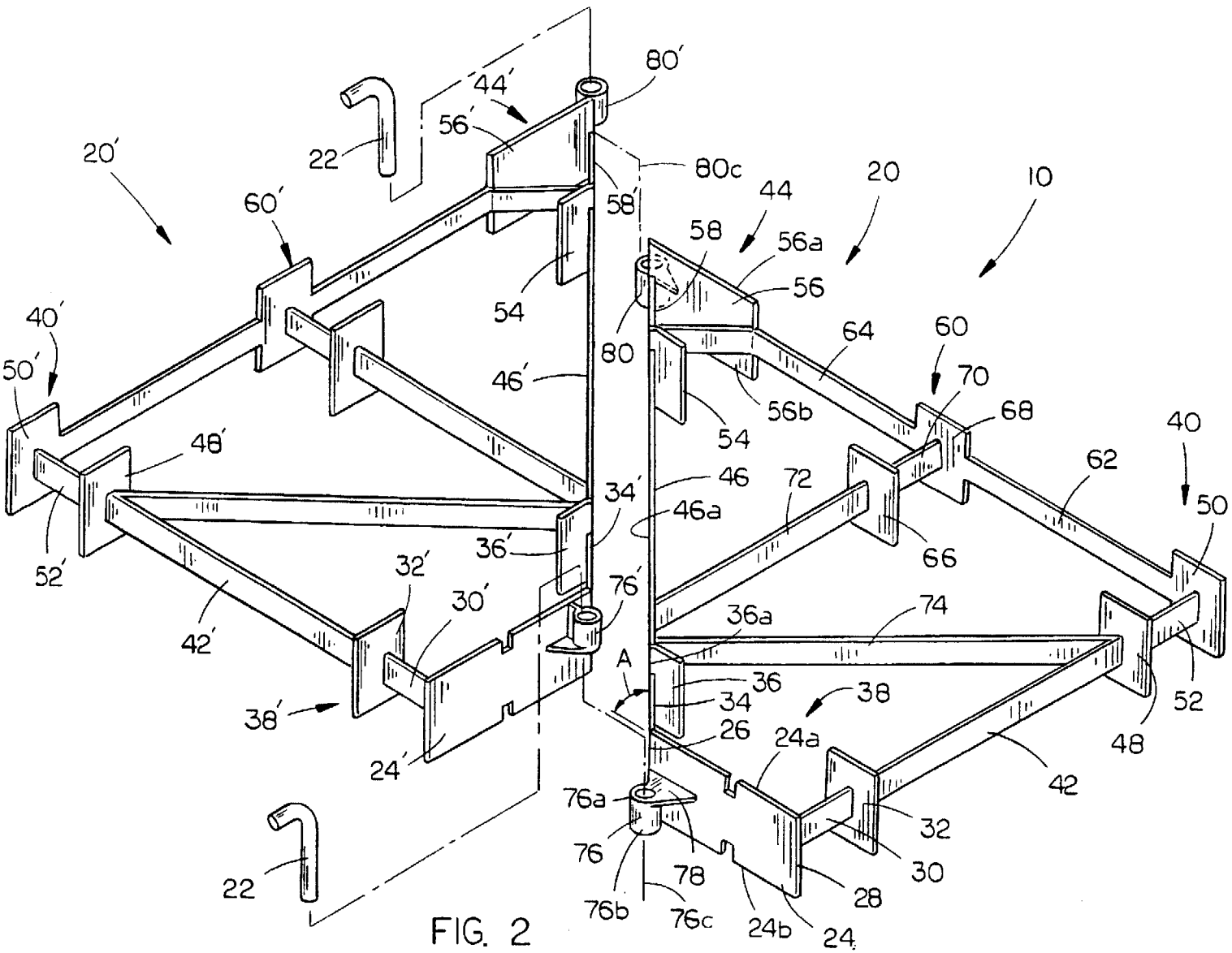
FIG. 2 is an enlarged exploded perspective view of the corner joint tie.

Referring now to FIG. 2, corner tie 10 is formed of two identical tie halves 20 and 20', connected together by connector pins 22. Because first tie half 20 is identical to second tie half 20', only the first tie half 20 will be described in detail herein.

Tie half 20 includes a forward elongated plate 24 having forward and rearward surfaces, and inward and outward opposing vertical edges 26 and 28 respectively. A first strap 30 extends rearwardly from the rearward surface of the first plate and is mounted to a forward surface of a rearward vertically oriented plate 32. Rearward plate 32 is oriented parallel to forward plate 24 and spaced therefrom to retain the thickness of form panel 12 therebetween (as shown in FIG. 1). A second strap 34 extends rearwardly from the inward vertical edge 26 of forward plate 24, in a horizontal plane and at an angle A (measured within the horizontal plane) between 0° and 90°. Angle A is equal to one-half of the desired angle of intersection between form panels 12 and 14. Thus, since the form panels 12 and 14 are shown in the figures at a right angle, angle A would be 45° in the configuration shown in the drawings.

A second rearward plate 36 is mounted on the rearward end of second strap 34, and is co-planar with rearward plate 32. As shown in FIG. 1, forward plate 24 and rearward plate 36 retain the inward end **12*a* of form panel 12 in position. Although rearward plates 32 and 36 are shown in the drawings as separate and individual plates, these plates could be connected to form a single elongated rearward plate spaced parallel rearwardly of forward plate 24**, if so desired.

As shown in FIG. 2, the combination of forward plate 24, rearward plates 32 and 36, and the associated straps 30 and 34, combine to form a first form panel retainer, designated generally at 38. A second form panel retainer is designated generally at 40 and is connected to the first form panel retainer 38 by an elongated first connector rod 42 extending rearwardly from the rearward surface of first rearward plate 32, in a horizontal plane and aligned with first strap 30. A third form panel retainer 44 is connected to first form panel retainer 38 by a second connector rod 46 which extends rearwardly from the inward edge **36*a* of second rearward plate 36, and is located within a horizontal plane and aligned with second strap 34 at angle A relative to forward plate 24 and rearward plate 36**.

Second form panel retainer 40 includes a vertically oriented forward plate 48 mounted on the rearward end of first connector rod 42, and oriented parallel to forward and rearward plates 24 and 32 of the first form panel retainer 38. Second form panel retainer 40 also includes a rearward plate 50 connected parallel and rearwardly of forward plate 48 by a strap 52. As shown in FIG. 2, strap 30 is aligned with first connector rod 42, which is aligned with strap 52 of the second form panel retainer 40. Forward and rearward plates 48 and 50 are spaced apart a distance to retain the thickness of form panel 18 therebetween, as shown in FIG. 1.

Referring once again to FIG. 2, third form panel retainer 44 includes a forward plate 54 connected in parallel relationship to a rearward plate 56 by a strap 58. Strap 58 is preferably aligned with connector rod 46 and strap 34 at angle A. Forward and rearward plates 54 and 56 of third form panel retainer 44 are spaced apart a distance to receive the thickness of form panel 18 therebetween, as shown in FIG. 1. First and second connector rods 42 and 46 have lengths which retain the forward plates 48 and 54 and rearward plates 50 and 56 of second and third form panel retainers 40 and 44 in co-planar relationship, so as to retain form panel 18 therein. Connector rods 42 and 46 are formed with a length substantially equal to the thickness of the concrete wall which is to be poured between form panels 12 and 18.

A fourth form panel retainer 60 is mounted between second and third form panel retainers 40 and 44, and connected thereto by members 62 and 64, respectively. Fourth form panel retainer 60 includes a forward plate 66 co-planar with forward plates 48 and 54, and a rearward plate 68 co-planar with rearward plates 50 and 56. Forward and rearward plates 66 and 68 are connected together by strap 70 at a distance apart to retain form panel 18 therebetween. A connector rod 72 extends forwardly from the forward face of forward panel 66 and is mounted to second connector rod 46, to stabilizer fourth form panel retainer 60 in position. Members 62 and 64 extend outwardly in opposite directions from rearward panel 68 to rearward panels 50 and 56, to further stabilize fourth form panel retainer 60.

A cross-member 74 is provided between the forward plate 48 of second form panel retainer 40 and second connector rod 46, for further stabilization of tie half 20.

A vertically oriented sleeve 76 is mounted forwardly of the forward surface of forward plate 24 by an orthogonally mounted flange 78. Sleeve 76 has a first end **76*a* located midway between the upper and lower edges 24*a* and 24*b* of forward plate 24, and a lower end 76*b* extending downwardly a distance equal to the lower edge 24*b* of forward plate 24. Thus, sleeve 76 has a vertical height substantially equal to one-half the vertical height of forward plate 24. Sleeve 76 has a vertical axis 76*c* located in a vertical plane co-planar with the inward vertical face 46*a* of connector rod 46**.

Similarly, a second sleeve 80 is mounted rearwardly of the rearward face of third form panel retainer rearward plate 56, with its central axis **80*c* co-planar with the inward face 46*a* of connector rod 46 and first sleeve axis 76*c*. Rearward sleeve 80 is also one-half the vertical height of rearward plate 56 and extends downwardly from midway between the upper and lower edges 56*a* and 56*b* of third form panel retainer rearward plate 56**.

As noted above, second tie half 20' is identical to first tie half 20, but is inverted in an upside down position. Thus, second tie half 20' includes a forward plate 24', a first form panel retainer 38', a second form panel retainer 40', a third form panel retainer 44', and a fourth form panel retainer 60'. First form panel retainer 38' includes forward plate 24', rearward plates 32' and 36', and straps 30' and 34'. Second form panel retainer 40' includes forward plate 48', rearward plate 50', and strap 52'. Third form panel retainer 44' includes forward plate 54', rearward plate 56' and strap 58'. Second tie half 20' also includes first and second connector rods 42' and 46', as well as a forward sleeve 76' and a rearward sleeve 80'.

Referring again to FIG. 1, tie halves 20 and 20' are first installed on form panels 12 and 18 and form panels 14 and 16, respectively. Sleeves 76 and 76' on forward plates 24 and 24' are then aligned coaxially. A connector pin 22 is then journaled through sleeves 76' and 76 to interconnect the forward portions of tie halves 20 and 20'. Rearward sleeves 80 and 80' are also aligned and connected by a connector pin 22 journaled therethrough. Form panels 12 and 18 are thereby maintained in appropriate alignment with form panels 14 and 16 to form a corner of the desired angle in a poured concrete wall.

It can be seen in FIG. 1 that a plurality of ties 10 may be vertically aligned on the upper and lower ends of the form panels, and they may be all interconnected by a connector pin 22 which extends between the sleeves 76 and 76' of one tie to similar sleeves 76 and 76' of a second tie 10. In the alternative, connector pins 22 may be short links which are journaled on each tie individually, as shown in FIG. 2.

Whereas the invention has been shown and described in connection with the preferred embodiment thereof, many modifications, substitutions and additions may be made which are within the intended broad scope of the appended claims.

I claim:

1. In combination:

a first pair of parallel, spaced apart form panels having first and second ends;

a second pair of parallel, spaced apart form panels having first and second ends; and a tie for interlocking the first ends of the first pair of form panels with the first ends of the second pair of form panels and with the first and second pairs of panels disposed at an angle of less than 180° with respect to one another, to form a corner;

said tie including:

a first tie half connected to the first ends of said first pair of form panels, retaining the panels in spaced apart parallel relationship;

a second tie half independent of the first tie half and substantially identical thereto, connected to the first ends of said second pair of form panels, retaining the panels in spaced apart parallel relationship; and connector means releasably connecting the first tie half to the second tie half;

said first tie half including:

first means for retaining a forward panel of the first pair of panels in an upright position;

second means for retaining a rearward panel of the first pair of panels, in an upright position; and a connector rod connecting the first and second panel retaining means, to retain the panels in spaced apart, parallel relationship; and said second tie half including:

third means for retaining a forward panel of the second pair of panels in an upright position;

fourth means for retaining a rearward panel of the second pair of panels in an upright position; and a connector rod connecting the third and fourth panel retaining means, to retain the second pair of panels in spaced apart parallel relationship;

said first tie half further including a connector strap connecting the first and second panel retaining means, said connector strap oriented at an angle relative to the first pair of form panels which is one-half the angle of the corner formed between the first and second pair of panels;

said second tie half further including a connector strap connecting the third and fourth panel retaining means, said connector strap oriented at an angle relative to the second pair of form panels which is one-half the angle of the corner; and said connector means releasably connecting the first and second tie halves with the first tie half connector strap abutting the second tie half.

2. The combination of claim 1, wherein said connector means includes:

a first sleeve mounted on the first panel retaining means, with a vertically oriented longitudinal axis;

a second sleeve mounted on the second panel retaining means, with a vertically oriented longitudinal axis;

a third sleeve mounted on the third panel retaining means, with a vertically oriented longitudinal axis;

a fourth sleeve mounted on the fourth panel retaining means, with a vertically oriented longitudinal axis;

said sleeves located for coaxial alignment of the first and third sleeves and second and fourth sleeves, respectively, when the first and second tie halves are connected;

a first connector pin removably journaled through the aligned first and third sleeves; and a second connector pin removably journaled through the aligned second and fourth sleeves.

3. In combination:

a first pair of parallel, spaced apart form panels having first and second ends;

a second pair of parallel, spaced apart form panels having first and second ends; and a tie for interlocking the first ends of the first pair of form panels with the first ends of the second pair of form panels and with the first and second pairs of panels disposed at an angle of less than 180° with respect to one another, to form a corner;

said tie including:

a first tie half connected to the first ends of said first pair of form panels, retaining the panels in spaced apart parallel relationship:

a second tie half independent of the first tie half, connected to the first ends of said second pair of form panels, retaining the panels in spaced apart parallel relationship: and connector means releasably connecting the first tie half to the second tie half;

said first tie half including:

first means for retaining a forward panel of the first pair of panels in an upright position;

second means for retaining a rearward panel of the first pair of panels, in an upright position; and a connector rod connecting the first and second panel retaining means, to retain the panels in spaced apart, parallel relationship; and said second tie half including:

third means for retaining a forward panel of the second pair of panels in an upright position;

fourth means for retaining a rearward panel of the second pair of panels in an upright position; and a connector rod connecting the third and fourth panel retaining means, to retain the second pair of panels in spaced apart parallel relationship;

said first tie half further including a connector strap connecting the first and second panel retaining means, said connector strap oriented at an angle relative to the first pair of form panels which is one half the angle of the corner formed between the first and second pair of panels;

said second tie half further including a connector strap connecting the third and fourth panel retaining means, said connector strap oriented at an angle relative to the second pair of form panels which is one half the angle of the corner; and said connector means releasably connecting the first and second tie halves with the first tie half connector strap abutting the second tie half connector strap, to form the corner.

4. The combination of claim 3, wherein said connector means includes:

a first sleeve mounted on the first panel retaining means, with a vertically oriented longitudinal axis;

a second sleeve mounted on the second panel retaining means, with a vertically oriented longitudinal axis;

a third sleeve mounted on the third panel retaining means, with a vertically oriented longitudinal axis;

a fourth sleeve mounted on the fourth panel retaining means, with a vertically oriented longitudinal axis;

said sleeves located for coaxial alignment of the first and third sleeves and second and fourth sleeves, respectively, when the first and second tie halves are connected;

a first connector pin removably journaled through the aligned first and third sleeves; and a second connector pin removably journaled through the aligned second and fourth sleeves.

5. In combination:

a first pair of parallel, spaced apart form panels having first and second ends;

a second pair of parallel, spaced apart form panels having first and second ends; and a tie for interlocking the first ends of the first pair of form panels with the first ends of the second pair of form panels and with the first and second pairs of panels disposed at an angle of less than 180° with respect to one another, to form a corner;

said tie including:

a first tie half connected to the first ends of said first pair of form panels, retaining the panels in spaced apart parallel relationship;

a second tie half independent of the first tie half and substantially identical thereto, connected to the first ends of said second pair of form panels, retaining the panels in spaced apart parallel relationship; and connector means releasably connecting the first tie half to the second tie half;

said first tie half including:

first means for retaining a forward panel of the first pair of panels in an upright position;

second means for retaining a rearward panel of the first pair of panels, in an upright position; and a connector rod connecting the first and second panel retaining means, to retain the panels in spaced apart, parallel relationship; and said second tie half including:

third means for retaining a forward panel of the second pair of panels in an upright position;

fourth means for retaining a rearward panel of the second pair of panels in an upright position; and a connector rod connecting the third and fourth panel retaining means, to retain the second pair of panels in spaced apart parallel relationship;

said connector means including:

a first sleeve mounted on the first panel retaining means, with a vertically oriented longitudinal axis;

a second sleeve mounted on the second panel retaining means, with a vertically oriented longitudinal axis;

a third sleeve mounted on the third panel retaining means, with a vertically oriented longitudinal axis;

a fourth sleeve mounted on the fourth panel retaining means, with a vertically oriented longitudinal axis;

said sleeves located for coaxial alignment of the first and third sleeves and second and fourth sleeves, respectively, when the first and second tie halves are connected;

a first connector pin removably journaled through the aligned first and third sleeves; and a second connector pin removably journaled through the aligned second and fourth sleeves.

6. In combination:

a first pair of parallel, spaced apart form panels having first and second ends;

a second pair of parallel, spaced apart form panels having first and second ends; and a tie for interlocking the first ends of the first pair of form panels with the first ends of the second pair of form panels and with the first and second pairs of panels disposed at an angle of less than 180° with respect to one another, to form a corner;

said tie including:

a first tie half connected to the first ends of said first pair of form panels, retaining the panels in spaced apart parallel relationship;

a second tie half independent of the first tie half, connected to the first ends of said second pair of form panels, retaining the panels in spaced apart parallel relationship; and connector means releasably connecting the first tie half to the second tie half:

said first tie half including:

first means for retaining a forward panel of the first pair of panels in an upright position;

second means for retaining a rearward panel of the first pair of panels, in an upright position; and a connector rod connecting the first and second panel retaining means, to retain the panels in spaced apart, parallel relationship; and said second tie half including:

third means for retaining a forward panel of the second pair of panels in an upright position;

fourth means for retaining a rearward panel of the second air of panels in an upright position; and a connector rod connecting the third and fourth panel retaining means, to retain the second pair of panels in spaced apart parallel relationship;

said connector means including:

a first sleeve mounted on the first panel retaining means, with a vertically oriented longitudinal axis;

a second sleeve mounted on the second panel retaining means, with a vertically oriented longitudinal axis;

a third sleeve mounted on the third panel retaining means, with a vertically oriented longitudinal axis;

a fourth sleeve mounted on the fourth panel retaining means, with a vertically oriented longitudinal axis;

said sleeves located for coaxial alignment of the first and third sleeves and second and fourth sleeves, respectively, when the first and second tie halves are connected;

a first connector pin removably journaled through the aligned first and third sleeves; and a second connector pin removably journaled through the aligned second and fourth sleeves.

7. In combination:

a first pair of parallel, spaced apart form panels having first and second ends;

a second pair of parallel, spaced apart form panels having first and second ends; and a tie for interlocking the first ends of the first pair of form panels with the first ends of the second pair of form panels and with the first and second pairs of panels disposed at an angle of less than 180° with respect to one another, to form a corner;

said tie including:

a first tie half connected to the ends of said first pair of form panels, retaining the panels in spaced apart parallel relationship;

a second tie half independent of the first tie half, connected to the ends of said second pair of form panels, retaining the panels in spaced-apart parallel relationship; and connector means releasably connecting the first tie half to the second tie half including:

a first sleeve mounted on the first tie half, with a vertically oriented longitudinal axis;

a second sleeve mounted on the first tie half and spaced from the first sleeve, with a vertically oriented longitudinal axis;

a third sleeve mounted on the second tie half, with a vertically oriented longitudinal axis;

a fourth sleeve mounted on the second tie half and spaced from the third sleeve, with a vertically oriented longitudinal axis;

said sleeves located for coaxial alignment of the first and third sleeves and second and fourth sleeves, respectively, when the first and second tie halves are connected;

a first connector pin removably journaled through the aligned first and third sleeves; and a second connector pin removably journaled through the aligned second and fourth sleeves.

* * * * *